United States Patent [19]

Terrulli

[11] 4,056,895

[45] Nov. 8, 1977

[54] NOVELTY TOY

[76] Inventor: Antonio J. Terrulli, 4142 N. Campbell, Chicago, Ill. 60618

[21] Appl. No.: 738,108

[22] Filed: Nov. 2, 1976

[51] Int. Cl.[2] ..... A63H 33/00

[52] U.S. Cl. ..... 46/1 R

[58] Field of Search ..... 46/1 R, 7, 14, 91, 92, 46/11, 115, 116; 273/1 R; 222/78, 79

[56] References Cited

U.S. PATENT DOCUMENTS

| | | | |
|---|---|---|---|
| 2,758,418 | 8/1956 | Troppe | 46/91 |
| 3,237,340 | 3/1966 | Knott | 46/1 R |
| 3,878,639 | 4/1975 | Scheelar et al. | 46/1 R |

*Primary Examiner*—Louis G. Mancene
*Assistant Examiner*—Mickey Yu

[57] ABSTRACT

A novelty toy is formed in the shape of a miniature toilet bowl with a closeable cover. Upon the cover being opened, a stem moves in an outward direction and dispenses a liquid spray; a plurality of members in the shape of flower petals are concentrically disposed about the stem.

6 Claims, 4 Drawing Figures

NOVELTY TOY

BACKGROUND OF THE INVENTION

1. Field of the Invention

The field of the present invention relates to a novelty toy.

2. Description of the Prior Art

There is known an ash holder in the form of a flower, and various ashtrays are also known.

SUMMARY OF THE INVENTION

It is an object of my present invention to provide a novelty toy of appeal to certain members of the public, particularly to those visiting the Rose Bowl.

I accordingly provide a novelty toy formed in the shape of a miniature toilet bowl which includes a recessed bowl having a stand attached thereto, a longitudinal recess formed within the said stand and communicating with the bowl recess, a piston which has a cavity formed therein, and wherein the piston is disposed and longitudinally movable within the longitudinal recess and formed with an opening, a hollow stem protruding outwardly from the piston and inwardly into the cavity and formed with a nozzle at the outward end thereof, a compression spring disposed within the longitudinal recess and in contact with the piston for urging the latter to move outwardly from the bowl, a cover hingeably attached to the bowl and normally in a closed position for covering the bowl recess and for keeping the stem within the bowl, and means for filling the cavity with pressurized liquid through the opening upon an outward movement of the piston. Upon the cover being lifted from the bowl, the stem moves in an upward direction, and the pressurized liquid is dispensed from the nozzle upon the cavity having been filled with the liquid. A plurality of members are concentrically disposed about the stem and are movable therewith; the members are preferably in the shape of flower petals. The filling means include a tank which may be filled with the liquid and attached to the bowl above the cover level; the bowl is formed with a duct permanently communicating with the tank recess and upon an upward movement of the piston the duct communicates with the opening. Release means are provided for releasing the cover from the closed position, and the release means preferably comprise a hook attached to the cover, and a spring-loaded pin slidable within the bowl and movable in an outward direction therefrom. The pin normally engages with the hook for preventing the release of the cover, upon the pin being moved outwardly, the cover may be disengaged from the hook. A tension spring is attached to the bowl and to the cover for keeping the latter in an upright position upon release of the spring-loaded pin, and a second cover is provided for closing the tank; the liquid is preferably perfume.

BRIEF DESCRIPTION OF THE DRAWING

My invention will be better understood with reference to the accompanying drawing in which.

DESCRIPTION OF THE PREFERRED EMBODIMENT

Figure 2:
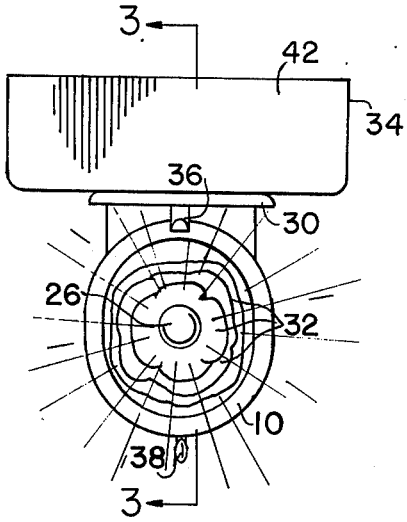
FIG. 2 shows a plan view corresponding to FIG. 1.
Figure 3:
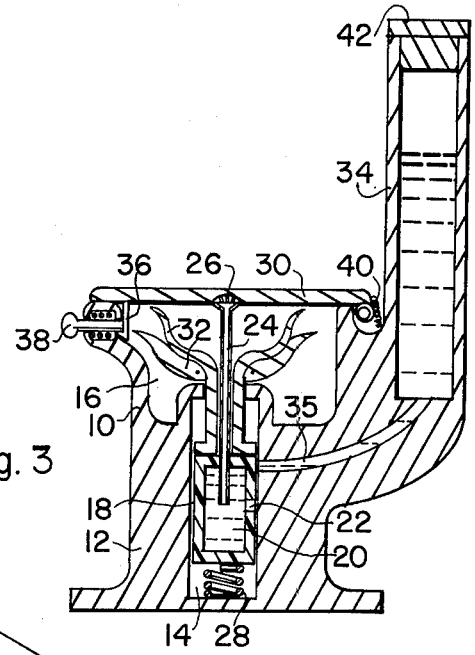
FIG. 3 is a cross-section through FIG. 2 along the lines 3—3 with the cover closed.
Figure 1:
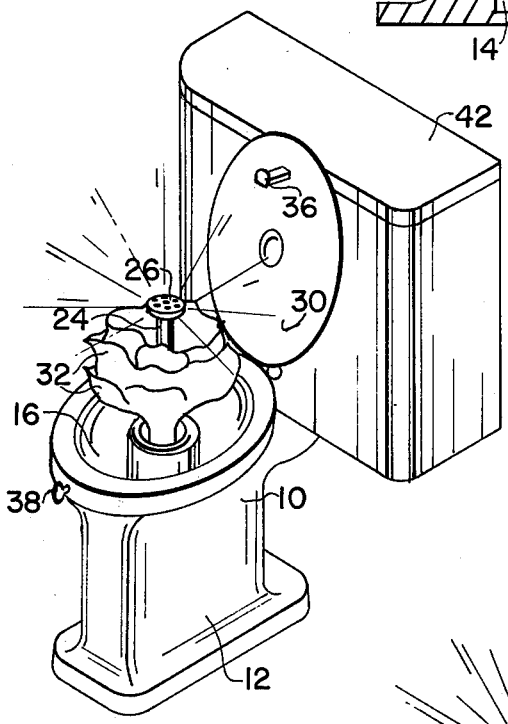
FIG. 1 shows a perspective view of the novelty toy, according to my invention, with the cover open.
Figure 4:
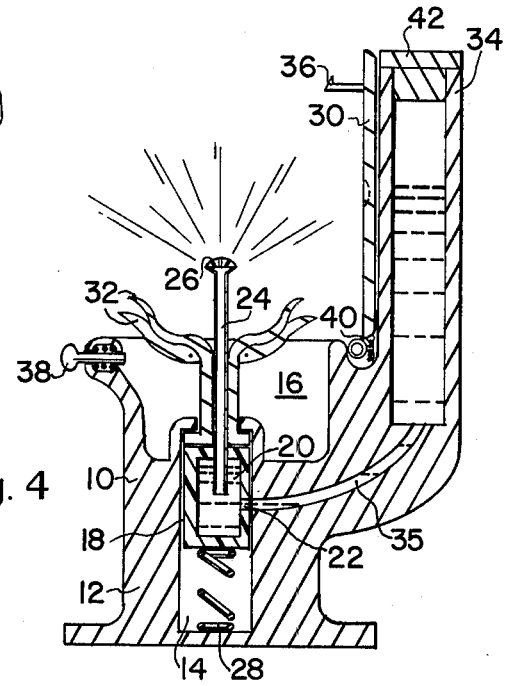
FIG. 4 corresponds to FIG. 3 with the cover being open.

Referring now to the drawing, a novelty toy, according to my invention, is formed in the shape of a miniature toilet bowl and includes a recessed bowl 10 which has a stand 12 attached thereto; a longitudinal recess 14 is formed within the stand 12 and communicates with the bowl recess 16. A piston 18 has a cavity 20 formed therein, and the piston 18 is disposed and longitudinally movable within the longitudinal recess 14, and is formed with an opening 22. A hollow stem 24 protrudes outwardly from the piston 18, and inwardly into the cavity 20, and is formed with a nozzle 26 at the outward end thereof. A compression spring 28 is disposed within the longitudinal recess 14 and is in contact with the piston 18 for urging the latter to move outwardly from the bowl 10. A cover 30 is hingeably attached to the bowl 10 and is normally in a closed position for covering the bowl recess 16, and for keeping the stem 24 within the bowl 10. Means are provided for filling the cavity 20 with pressurized liquid through the opening 22 upon an outward movement of the piston 18; upon the cover 30 being lifted from the bowl 10, the stem 24 moves in an upward direction, and the pressurized liquid is dispensed from the nozzle 26 upon the cavity 20 having been filled with the liquid. A plurality of members 32 are concentrically disposed about the stem 24 and are movable therewith; the members 32 are preferably in the shape of flower petals. The filling means preferably include a tank 34 which may be filled with the liquid and attached to the bowl 10 above the cover level; the bowl 10 is formed with a duct 35 which permanently communicates with the tank recess 36; upon an upward movement of the piston 18 the duct 35 also communicates with the opening 22. Release means are provided for releasing the cover 30 from the closed position, and the release means preferably include a hook 36 attached to the cover 30, and a spring-loaded pin 38 slidable within the bowl 10 and movable in an outward direction therefrom. The pin 38 normally engages the hook 36 for preventing the release of the cover 30; upon the pin 38 being moved outwardly, the cover 30 may be disengaged from the hook 36. A tension spring 40 is attached to the bowl 10 and the cover 30 for keeping the latter in an upright position upon release of the spring-loaded pin 38, and a second cover 42 is provided for closing the tank 34; the liquid is preferably perfume.

Although the invention has been described with respect to a preferred version thereof, it is to be understood that it is not to be so limited since changes can be made therein which are within the full intended scope of the appended claims.

What is claimed is:

1. A novelty toy formed in the shape of a miniature toilet bowl comprising:

a recessed bowl having a stand attached thereto;

a longitudinal recess formed within said stand and communicating with the bowl recess;

a piston having a cavity formed therein, said piston being disposed and longitudinally movable within said longitudinal recess, and being formed with an opening;

a hollow stem protruding outwardly from said piston and inwardly into said cavity, and formed with a nozzle at the outward end thereof;

a compression spring disposed within said longitudinal recess and in contact with said piston for urging the latter to move outwardly from said bowl;

a cover hingeably attached to said bowl and normally in a closed position for covering said bowl recess and for keeping said stem within said bowl; and means for filling said cavity with pressurized liquid through said opening upon an outward movement of said piston, whereby, upon said cover being lifted from said bowl, said stem moves in an upward direction, and said pressurized liquid is dispensed from said nozzle upon said cavity having been filled with the liquid.

2. A novelty toy according to claim 1 further comprising a plurality of members concentrically disposed about said stem and movable therewith, said members being in the shape of flower petals.

3. A novelty toy according to claim 1 wherein the filling means comprise a tank fillable with the liquid and attached to said bowl above the cover level, said bowl being formed with a duct permanently communicating with the tank recess and upon an upward movement of said piston communicating with said opening.

4. A novelty toy according to claim 1 further comprising release means for releasing said cover from the closed position.

5. A novelty toy according to claim 4, wherein said release means comprises a hook attached to said cover and a spring-loaded pin slidable within said bowl and movable in an outward direction therefrom, said pin normally engaging with said hook for preventing the release of said cover, whereby, upon said pin being moved outwardly, said cover is disengageable from said hook.

6. A novelty toy according to claim 5 further comprising a tension spring attached to said bowl and to said cover for keeping the latter in an upright position upon release of said spring-loaded pin, and a second cover for closing said tank, and wherein the liquid is perfume.

* * * * *